US009132993B1

(12) United States Patent
DiMartino et al.

(10) Patent No.: US 9,132,993 B1
(45) Date of Patent: Sep. 15, 2015

(54) LOAD SPREADER BAR PIPE CONNECTING SLEEVE WITH OFFSET END PLATE

(71) Applicant: Tandemloc, Inc., Havelock, NC (US)

(72) Inventors: William DiMartino, New Bern, NC (US); Drew Hansen, Havelock, NC (US)

(73) Assignee: Tandemloc, Inc., Havelock, NC (US)

( * ) Notice: Subject to any disclaimer, the term of this patent is extended or adjusted under 35 U.S.C. 154(b) by 0 days.

(21) Appl. No.: 14/322,959

(22) Filed: Jul. 3, 2014

(51) Int. Cl.
*B66C 1/00* (2006.01)
*B66C 1/12* (2006.01)

(52) U.S. Cl.
CPC ..... *B66C 1/12* (2013.01)

(58) Field of Classification Search
CPC ..... B66C 1/18; B66C 1/12; B66C 1/24; F16L 37/252; F16L 39/005; F16L 21/022; F16B 7/0413
See application file for complete search history.

(56) References Cited

U.S. PATENT DOCUMENTS

| | | | |
|---|---|---|---|
| 160,301 | A | 3/1875 | Brancher et al. |
| 367,578 | A | 8/1887 | Babb |
| 1,970,617 | A | 8/1934 | Morgan |
| 3,206,243 | A | 12/1962 | Miles |
| 3,362,167 | A | 1/1968 | Ward |
| 3,521,913 | A | 7/1970 | Verhein Donald et al. |
| 3,701,550 | A | 10/1972 | Jacobson |
| 3,822,850 | A | 7/1974 | Elias |
| 3,851,856 | A | 12/1974 | Berg |
| 4,215,891 | A | 8/1980 | Thiele |
| 4,247,136 | A | 1/1981 | Fouss et al. |
| 4,396,095 | A | 8/1983 | Wernli et al. |
| 4,538,849 | A | 9/1985 | Khachaturian et al. |
| 4,736,976 | A | 4/1988 | Berzenye |
| 4,842,314 | A | 6/1989 | Bellow |
| 4,858,960 | A | 8/1989 | Pharaon |
| 4,909,555 | A | 3/1990 | Blasi |
| 4,927,189 | A | 5/1990 | Burkit |
| 5,116,341 | A | 5/1992 | Cameron |
| 5,310,290 | A | 5/1994 | Spencer |
| 5,603,544 | A | 2/1997 | Bishop et al. |
| 5,863,085 | A | 1/1999 | Khachaturian |
| 6,079,760 | A | 6/2000 | Khachaturian |
| 6,179,349 | B1 | 1/2001 | Guzzoni |
| 6,296,288 | B1 | 10/2001 | Khachaturian |
| 6,302,448 | B1 | 10/2001 | Van Der Meer et al. |
| 6,390,523 | B2 | 5/2002 | Fujikawa et al. |
| 6,467,741 | B1 | 10/2002 | Shih |
| 7,387,470 | B2 | 6/2008 | McCracken |
| 7,584,932 | B2 | 9/2009 | Shih |
| 7,708,072 | B1 | 5/2010 | Hunziker |
| 7,967,352 | B2 | 6/2011 | DiMartino |
| 8,382,175 | B2 | 2/2013 | DiMartino |
| 2005/0199567 | A1 | 9/2005 | Tardiff |

*Primary Examiner* — Stephen Vu
(74) *Attorney, Agent, or Firm* — Ward & Smith, P.A.

(57) ABSTRACT

A pipe connecting sleeve with offset end plate is disclosed. The pipe connecting sleeve with offset endplate may include a flange having a first side and a second side; first and second insertion parts each including an extension portion extending from their respective sides of the flange each including a distal end, the distal end including an end plate, the end plates being adapted for abutment with an inside diameter of a spreader bar pipe, wherein the end plates are of a greater diameter than the extension portions and are fixed in an offset manner relative thereto; first and second grooves formed on their respective sides of the flange, the grooves being adapted for receiving an end of a spreader bar pipe.

12 Claims, 7 Drawing Sheets

LOAD SPREADER BAR PIPE CONNECTING SLEEVE WITH OFFSET END PLATE

FIELD OF THE INVENTION

The invention relates generally to load spreader bar pipe connecting sleeves typically used with load spreader bar assemblies in the shipping and container industry for the lifting and supporting of cargo. Specifically, the invention relates to load spreader bar pipe connecting sleeves having offset end plates.

BACKGROUND OF THE INVENTION

In the related and relevant "below the hook" art technology, shipping containers and similar loads are typically lifted by means of a "spreader bar" assembly that can generally consist of end caps that insert into each end of a pipe segment wherein the end caps are connected by a "Y" cable to a crane or other lifting mechanism. Spreader bar assemblies of various lengths can be made by using spreader bar pipe connecting sleeve in-between different lengths of pipe.

A variety of prior art patent documents relate to spreader bar assemblies or couplings for connecting a range of pipe segments. For instance, U.S. Pat. No. 160,301 to Brancher et al. and U.S. Pat. No. 367,578 to Babb are related to pipe couplings. Referring specifically to FIG. 4 in Brancher, a pipe connector is shown for joining two sections of pipe. Babb also discloses an apparatus for coupling two sections of pipe with reference to FIGS. 2 and 3 of Babb. However, the coupling devices shown in these two references are merely indicative of known prior devices for joining two segments of pipe.

Four patent documents in the name of Khachaturian relate to spreader bar assemblies. Namely, U.S. Pat. No. 4,538,849 discloses an adjustable spreader bar assembly having end portions which can be removably fitted to the ends of a section of pipe. The end caps disclosed in this patent can be most readily seen in FIGS. 4 through 11 of Khachaturian.

U.S. Pat. Nos. 6,079,760 and 6,296,288 relate to a multi-part spreader bar arrangement including a plurality of connectible sections including a pair of bar sections and a pair of end caps and also including detachable connections between the connectible sections. Referring specifically to the figures, the couplings and end caps disclosed in this patent are of threaded engagement.

U.S. Patent Application Publication No. 2005/0199567 to Tardiff discloses a spreader bar apparatus including a plurality of pipe sections which are connected through the use of a coupling wherein the coupling is connected to the pipe segments through the use of removable pins, as shown in FIGS. 1, 3, and 6 of Tardiff.

U.S. Pat. Nos. 7,967,352 and 8,382,175, both to DiMartino, disclose an end cap and a pipe connection sleeve, respectively for use in a spreader bar assembly. The end cap and pipe connection sleeve of DiMartino disclose an end cap and pipe connection sleeve having end plates (e.g., 26, 62, and 68) affixed substantially centered on an end portion thereof (e.g., 32, 60, and 66) as shown in FIGS. 3 and 6 of DiMartino.

Several disadvantages are known in the prior art. Generally, the installation or detachment of items for use in different lifts is a time consuming and laborious process. Usually, a user must stock pile various sized completed assemblies (spreader pipes attached to end caps, etc.) in order to handle different sized loads. Additionally, it is known that many of these prior art assemblies are made in permanent assemblies, such as end caps welded to spreader pipes, or in a manner that is difficult to assemble/disassemble (a multitude of bolts and nuts, etc.). Even further, it is known that tremendous pressures can be applied to the spreader bar assemblies during use and the prior art assemblies (especially assemblies having multiple spreader bar pipes joined together), exhibit sagging (See FIG. 1), and in some cases, as a result, even may buckle and fail under such pressures, especially at the connection joints of the spreader bar pipes (i.e., where the pipes are connected together), due to seating at the junctions of the spreader bar pipe ends and the pipe connection sleeve. As such, there remains a need for a pipe connecting sleeve for use with a load spreader bar assembly that substantially reduces or eliminates sagging, has improved strength, and provides a quick connect and disconnect for assembly/disassembly, but that also creates a tight connection under load, allows for easier storage and transport of spreader bars, provides optional pipe connection sleeve that allows for use with different diameter pipes, and allows for more than one pipe connection sleeve to be used in a single assembly while maintain load capacity.

SUMMARY OF THE INVENTION

The invention provides an improved pipe connecting sleeve for use in a spreader bar assembly for connecting a first and second spreader bar pipe. The pipe connecting sleeve may include a flange having a first side and a second side; a first insertion part including an extension portion extending from the flange first side including a distal end, the distal end including an end plate, the end plate being adapted for abutment with an inside diameter of the first spreader bar pipe, wherein the end plate is of a greater diameter than the extension portion and is fixed in an offset manner relative thereto; a second insertion part including an extension portion extending from the flange second side including a distal end, the distal end including an end plate, the end plate being adapted for abutment with an inside diameter of the second spreader bar pipe, wherein the end plate is of a greater diameter than the extension portion and is fixed in an offset manner relative thereto; a first groove formed on the first side of the flange, the first groove adapted for receiving an end of the first spreader bar pipe; and a second groove formed on the second side of the flange, the second groove adapted for receiving an end of the second spreader bar pipe. The end plates may be fixed to the extension portions in an offset manner, such that a greater portion of the end plate extends below an outer diameter of the extension portion than extends above the extension portion. The end plates may be fixed to the extension portions in an offset manner, such that a greater portion of the end plate extends below an outer diameter of the extension portion than extends above the extension portion to achieve a spacing Y. Y may be substantially equal to a vertical distance measured between a bottom most edge of the end plate and a bottom outer edge of its respective groove. Y may be substantially equal to a wall thickness of one of the spreader bar pipes minus in the range of about 0.03 of an inch. The pipe connecting sleeve may further include a fastener mechanism for securing at least one of the insertion parts to at least one of the spreader bar pipes. The end plates may include machined steel plates. The first or second grooves may extend outward from one of the first side or second sides of the flange. The first or second grooves may recesses into one of the first side or second sides of the flange. The first insertion part and second insertion part each may have a different diameter from one another. The first and second spreader bar pipes may be different diameters.

These and other advantages and features that characterize the invention are set forth in the claims annexed hereto and forming a further part hereof. However, for a better understanding of the invention, and of the advantages and objectives attained through its use, reference should be made to the Drawings and to the accompanying descriptive matter in which there are described exemplary embodiments of the invention.

DETAILED DESCRIPTION

Embodiments consistent with the underlying principles of the present invention include an improved spreader bar pipe connecting sleeve, and more specifically, a spreader bar pipe connecting sleeve having offset end plates that increase the efficiency of using and assembling spreader bar assemblies of various sizes, as well as improves overall strength, and substantially decreases or eliminates sagging of the spreader bar assembly while under load. A spreader bar pipe connecting sleeve may include multiple insertion ends for respective connection to respective spreader bar pipes, wherein the multiple insertion ends each preferably have an offset end plate fixed thereto. The inventors have discovered that by fixing the end plates in an offset matter (rather than being centered) relative to an end portion of the insertion ends, embodiments may provide a spreader bar pipe connecting sleeve that substantial reduces or eliminates sagging at the connection joints of assembled spreader bar pipes while under load, and further allows for more than one pipe connection sleeve to be used in a single assembly (e.g., to allow for three or more spreader bar pipe segments to be connected together), while maintaining load capacity. Embodiments further allow for quickly assembling/disassembling spreader bar assemblies of differing sizes as needed, including the ability to connect multiple spreader bar pipes together while maintaining a tight connection while under load, as well as load capacity.

Figure 1:
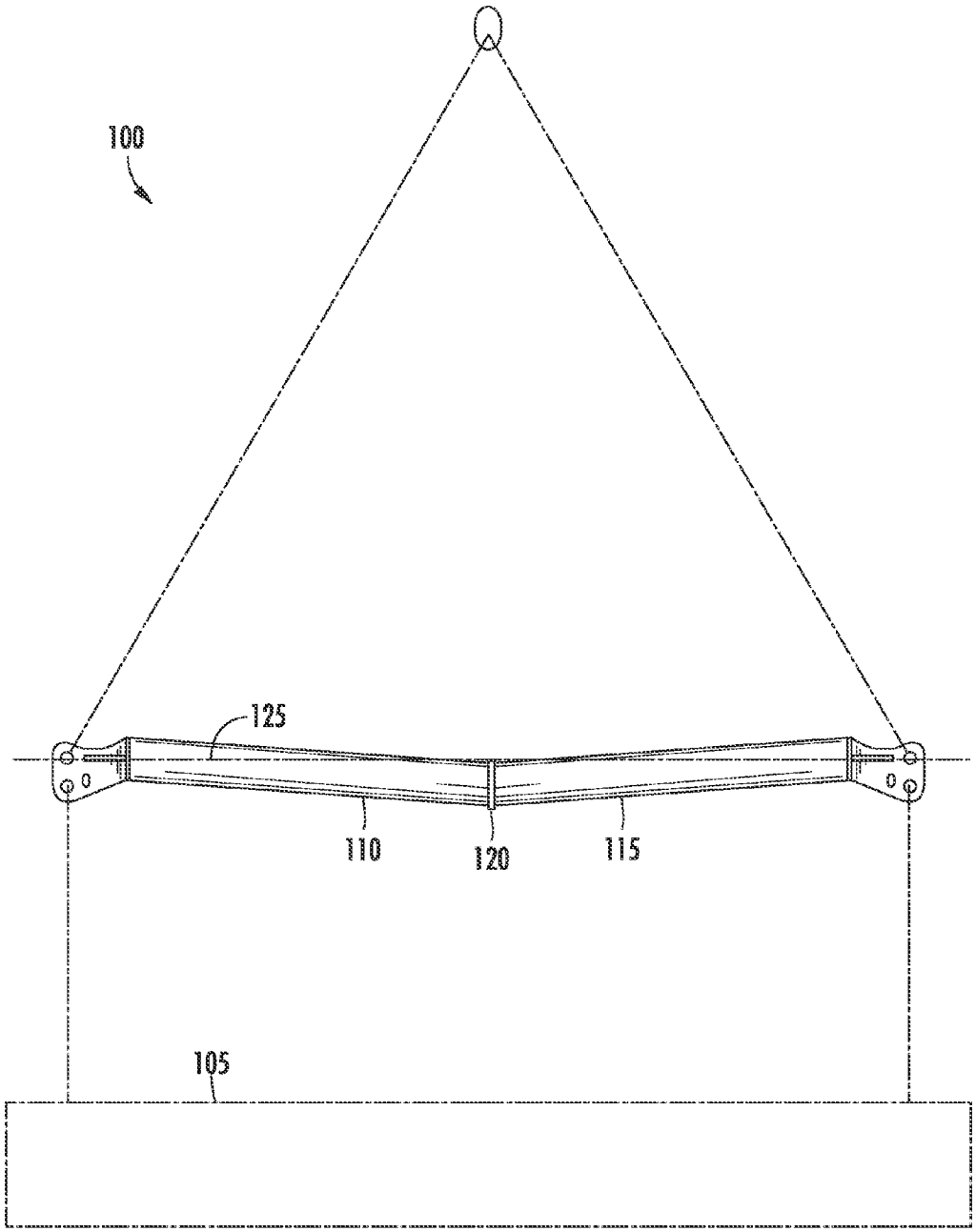
FIG. 1 shows an illustrative view of an assembled spreader bar assembly that includes a prior art pipe connection sleeve connecting spreader bar pipes together and shows the spreader bar assembly bowing while under load.
Figure 2A:
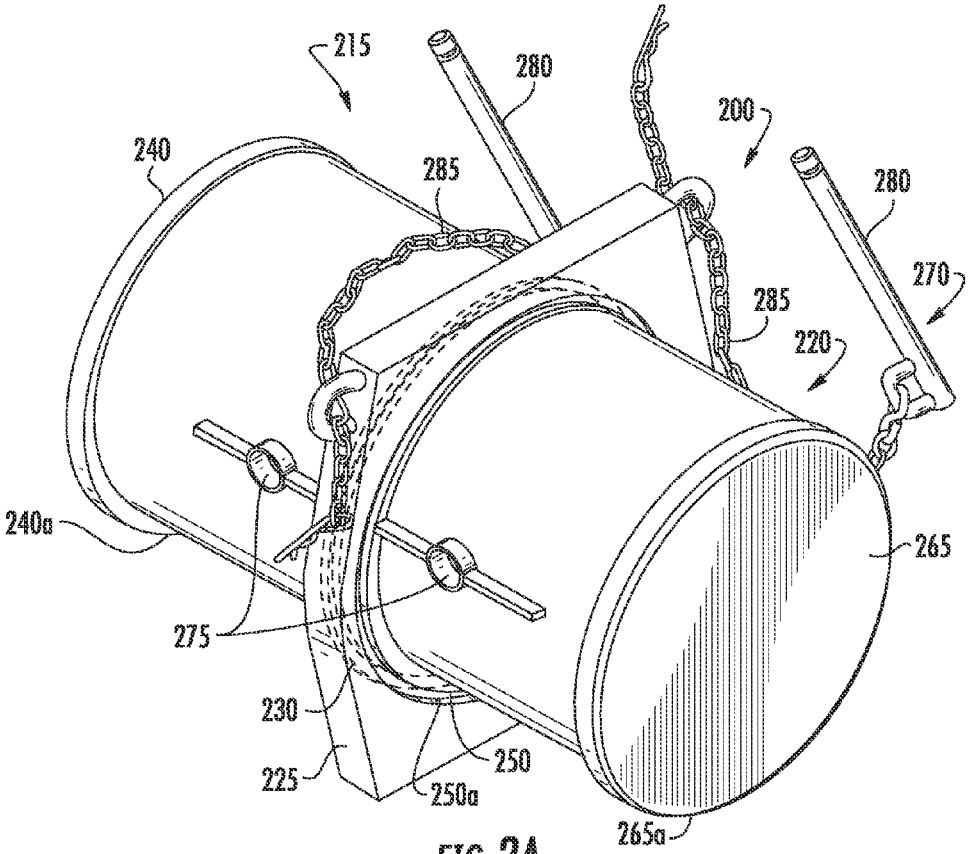
FIG. 2A shows a perspective view of a pipe connecting sleeve for connecting spreader bar pipes of substantially the same diameters together.
Figure 2B:
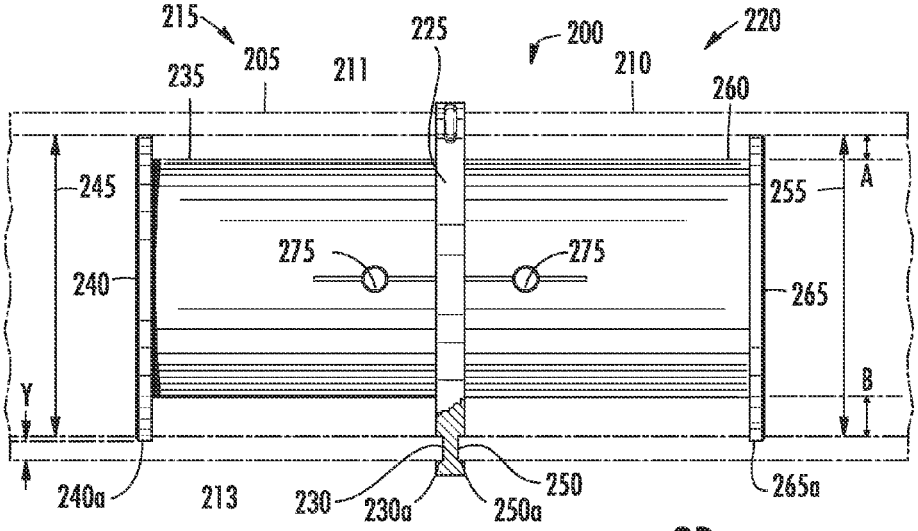
FIG. 2B shows a side view of the pipe connecting sleeve of FIG. 2A.

FIG. 1 is illustrative of an example conventional spreader bar assembly 100 under a load 105 that includes two spreader bar pipes 110 and 115, for example, connected using a conventional spreader bar pipe connection sleeve 120 that does not have end plates fixed in an offset manner. As illustrated in FIG. 1, in conventional spreader bar assemblies (e.g., 100), spreader bar pipes (e.g., 110 and 115) joined together using a conventional spreader bar pipe connection sleeve (e.g., 120) and not have end plates fixed in an offset manner, exhibit a sag in a downward direction, wherein the sag is due to seating at the junction of the ends of spreader bar pipes 110 and 115 and the pipe connection sleeve 120. If the sag is such that a top of the spreader bar pipes are at, or below, a centerline 125 (shown with hashed marks), of the spreader bar assembly 100, then the spreader bar pipes 110 and 115 will continue to deflect downward as load is applied, and reduce the normal load carrying capacity of the spreader bar pipes (i.e., it will buckle sooner than a single pipe of the same length). Additionally, the sagging effect reduces the ability to use multiple spreader bar pipe connection sleeves (e.g., two or more) as doing so would almost certainly result in a sag or increased sag, which would lead to a reduced load capacity (e.g., over that of a similar length assembly with a single pipe or an assembly with single spreader bar pipe connection sleeve). In some case, under heavy loads this can potentially lead to buckling and even a failure at the connection point(s). The invention described herein, provides an improved spreader bar pipe connection sleeve that implements the use of offset (un centered) endplates, which the inventors have discovered substantially reduces or eliminates all of the initial sag while maintaining load capacity. The invention also allows for the potential to use more than one spreader bar pipe connection sleeve to be used in a single spreader bar assembly while maintaining load capacity, thus enabling more versatile, convenient, and easy to use spreader bar assemblies e.g., more size options and easier storage and transport of assemblies (e.g., do not have to store/transport pre-assembled assemblies for each specific size, but rather can store a variety of unassembled spreader bars pipes and spreader bar pipe connecting sleeves and assemble the needed sizes on an as needed basis).

FIGS. 2A-2B and 3A-3B show details of a pipe connecting sleeve 200. Pipe connecting sleeve 200 may be used in connecting together two or more spreader bar pipes. For example, pipe connecting sleeve 200 may be used to connect a first spreader bar pipe 205 (shown with hash marks) to a second spreader bar pipe 210 (also shown with hash marks) both having a substantially the same diameter. Spreader bar pipe 205 and spreader bar pipe 210 may be of the same or differing lengths.

Pipe connecting sleeve 200 may include a top portion 211, a bottom portion 213, a first side 215, a second side 220, and a flange 225 located in a middle portion of pipe connecting sleeve 200 between first side 215 and a second side 220. First side 215 of pipe connecting sleeve 200 may include a groove 230 at flange 225 to capture a cut-end diameter of first spreader bar pipe 205. Groove 230 may be a recessed groove recessing inwardly into flange 225. First side 215 of pipe connecting sleeve 200 may further include a circular extension 235 extending from flange 225 and an end plate 240 fixed at an end of circular extension 235 for capturing an inner diameter 245 of first spreader bar pipe 205. Second side 220 of pipe connecting sleeve 200 may be substantially a symmetrical duplicate of first side 215. Second side 220 of pipe connecting sleeve 200 may include a groove 250 at flange 225 to capture a cut-end diameter 255 of second spreader bar pipe 210. Groove 250 may also be a recessed groove recessing inwardly into flange 225. Second side 220 of pipe connecting sleeve 200 may further include a circular extension 260 extending from flange 225 and an end plate 265 fixed at an end of circular extension 260 to capture inner diameter 255 of second spreader bar pipe 210. Pipe connecting sleeve 200 may connect first and second spreader bar pipes 205 and 210, respectively, for example, as shown in spreader bar assembly 400 in FIG. 4.

In a preferred embodiment, end plates 240 and 265 are substantial circular in shape, and have a diameter preferably greater than that of circular extension 235 and 260, respectively. End plates 240 and 265 are preferably fixed to circular extension 235 and 260, respectively, in an offset manner (off center), such that a greater portion B of end plates 240 and 265 extend beyond the outer diameter of circular extension 235 and 260, respectively, at bottom portion 213 than portion A at top portion 211 of pipe connecting sleeve 200, such that B>A. In one example, end plates 240 and 265 extend beyond the outer diameters of circular extension 235 and 260, respectively, at bottom portion 213 of pipe connecting sleeve 200 to achieve a spacing Y, wherein Y is a vertical distance measured from a bottom most edge 240*a* and 265*a* of end plate 240 and 265, respectively to a bottom inner edge 230*a* and 250*a* of groove 230 and 250, respectively. In a preferred embodiment, Y may be equal to a wall thickness of the corresponding spreader bar pipe (e.g., first spreader bar pipe 205 or second spreader bar pipe 210 respectively), minus in the range of about 0.03 of an inch. For example, for a spreader bar pipe having a 0.5 inch wall thickness Y may be in the range of about 0.47 of an inch.

Figure 3A:
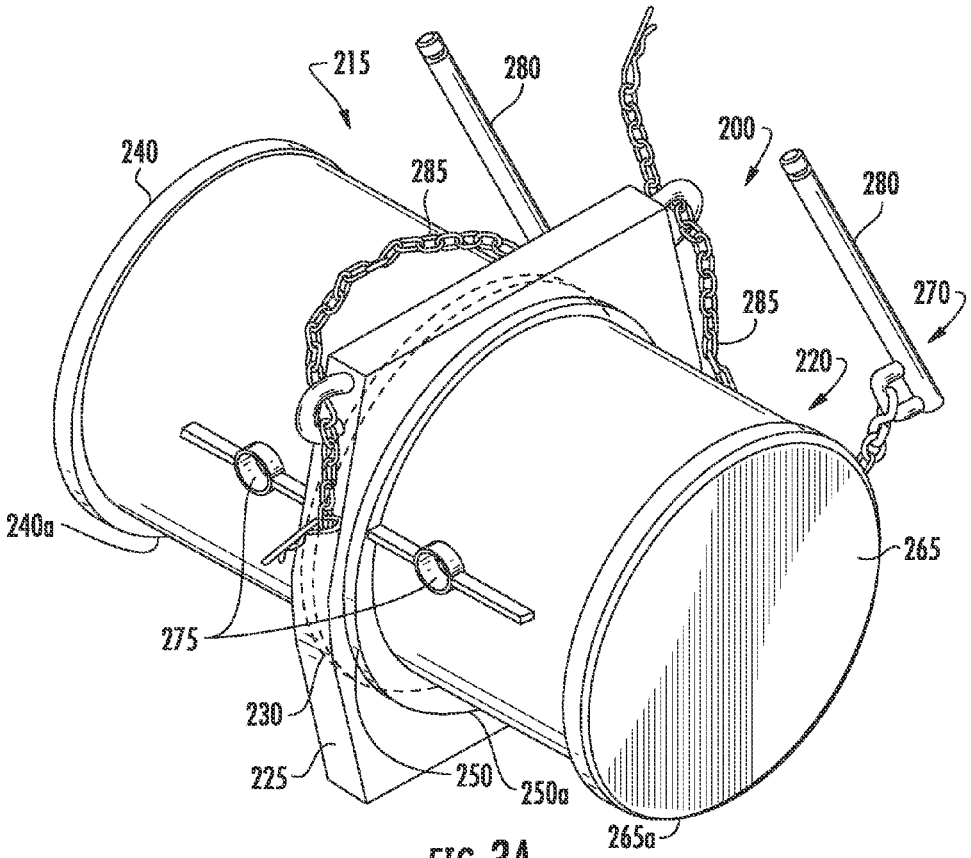
FIG. 3A shows a perspective view of another pipe connecting sleeve for connecting spreader bar pipes of substantially the same diameters together.
Figure 3B:
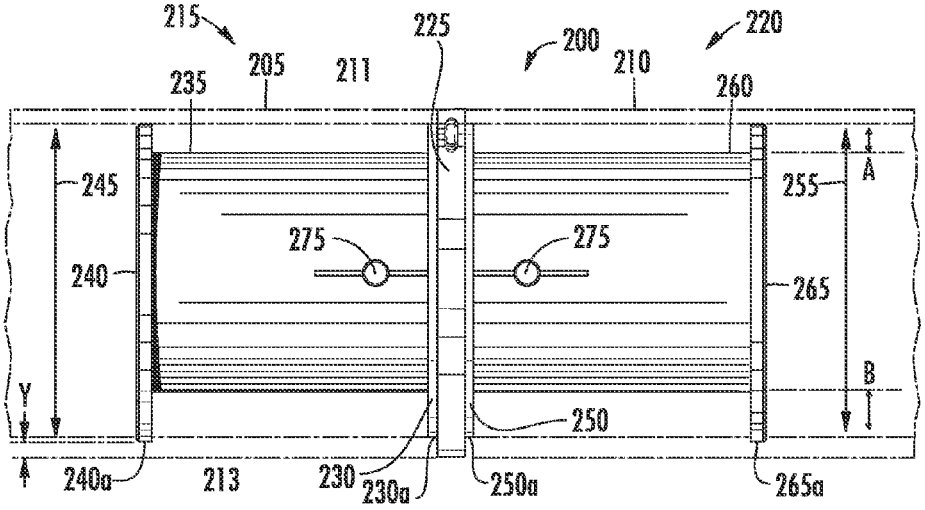
FIG. 3B shows a side view of the pipe connecting sleeve of FIG. 3A.

Grooves 230 and 250 may alternatively, extend as a shoulder from their respective sides of flange 225, instead of being recessed, to capture the cut-end diameter of the spreader bar pipe (see for example FIGS. 3A and 3B). In yet another alternative, one of grooves 230 and 250 may be a recessed groove and the other may extended as a shoulder.

First side 215 and second side 220 of pipe connecting sleeve 200 may further include one or more pin assemblies 270, or other suitable mechanism, preferably having a pin assembly 270 on each side of flange 225 for connecting pipe connecting sleeve 200 to first spreader bar pipe 205 and to second spreader bar pipe 210. Each spreader bar pipe 205 and 210 may have holes (not shown) that align with holes 275 in respective first side 215 and second side 220 of pipe connecting sleeve 200 to receive a connecting pin 280, or other suitable mechanism, of pin assembly 270. Connecting pin 280 may, itself, be attached to pipe connecting sleeve 200 via a chain 285, or other suitable mechanism.

Figure 4:
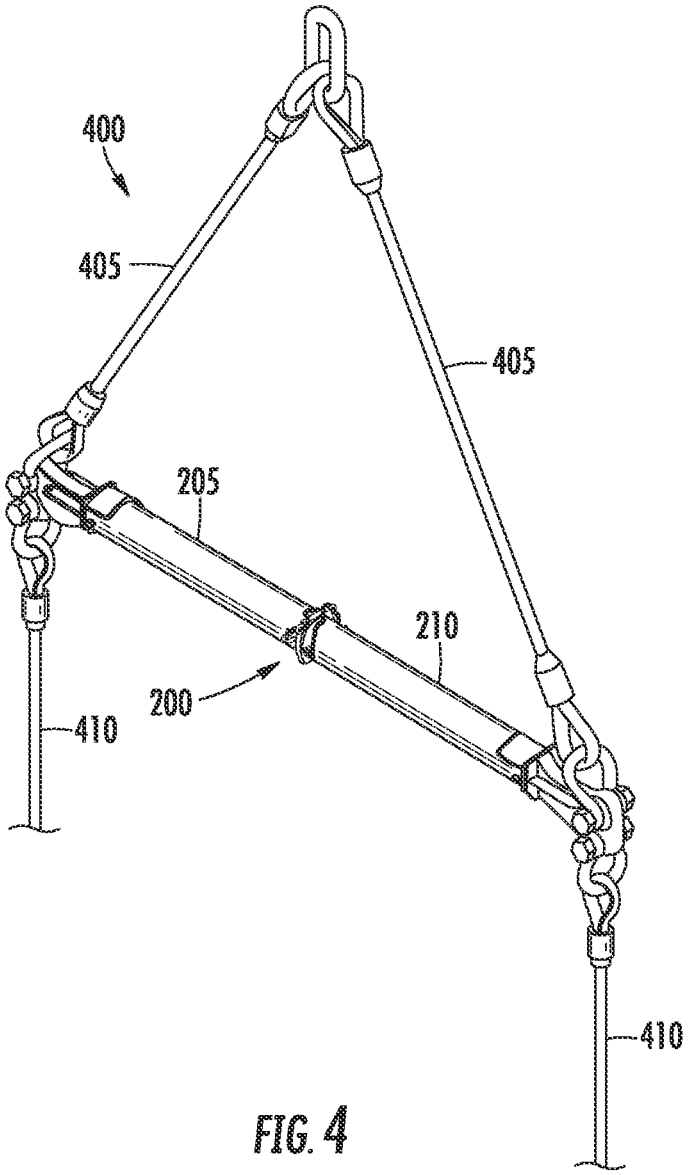
FIG. 4 shows a perspective view of an exemplary spreader bar assembly that shows a pipe connecting sleeve connecting spreader bar pipes of substantially the same diameters together.
Figure 5A:
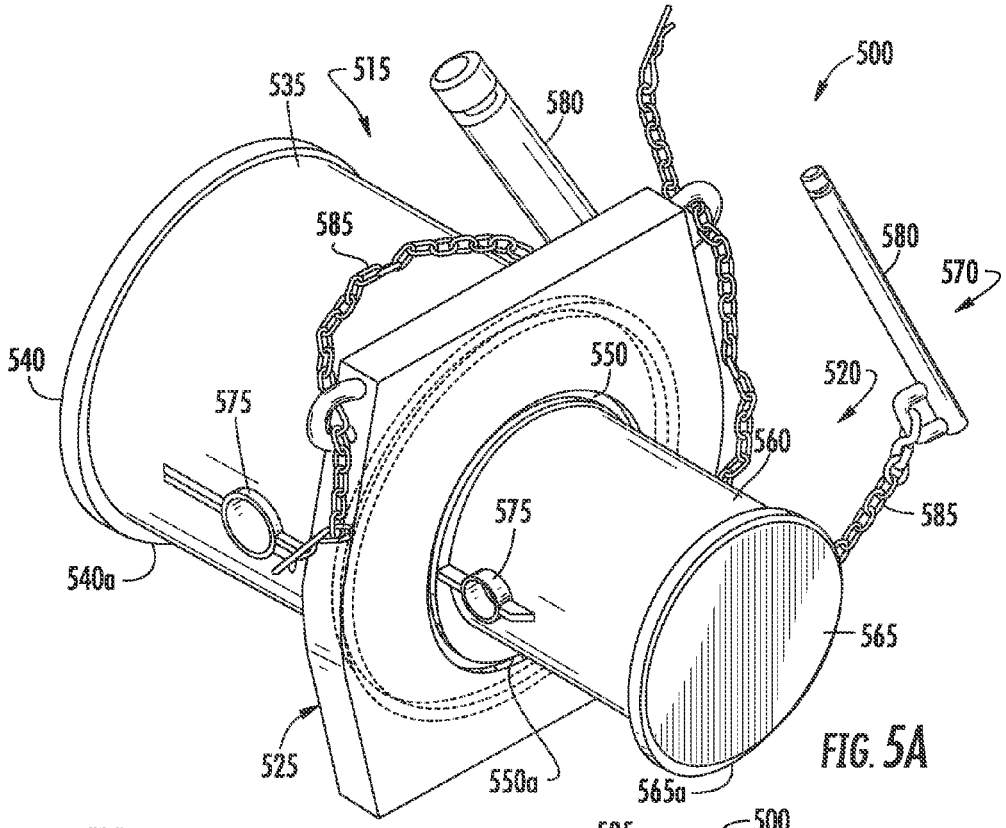
FIG. 5A shows a perspective view of a pipe connecting sleeve for connecting spreader bar pipes of different diameters together.
Figure 5B:
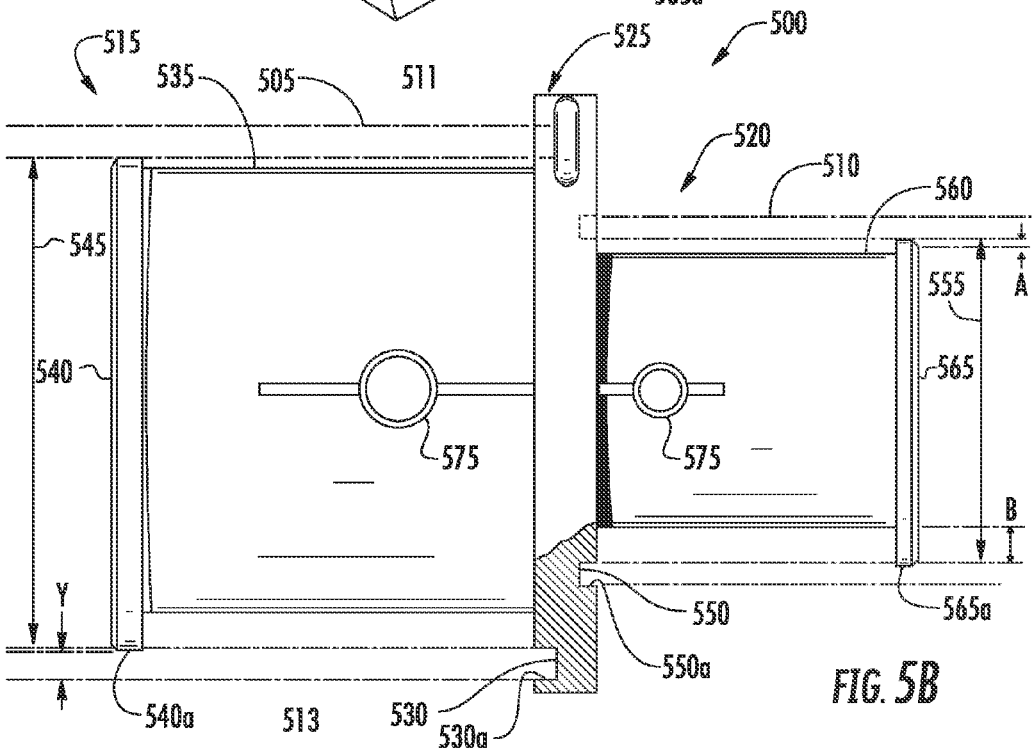
FIG. 5B shows a side view of the pipe connecting sleeve of FIG. 5A.

FIG. 4 shows an example spreader bar assembly 400 that may include one or more pipe connecting sleeves 200 and two or more spreader bars, e.g., first spreader bar pipe 205 and second spreader bar pipe 210. In one example, first spreader bar pipe 205 and second spreader bar pipe 210 are of substantially the same diameter and size and are joined together by pipe connecting sleeve 200. Spreader bar assembly 400 may further include cables 405, such as Y-cables, attaching first spreader bar pipe 205 and second spreader bar pipe 210, and one or more pipe connecting sleeves 200 to a lift mechanism such as a crane; and cables 410 attaching first spreader bar pipe 205 and second spreader bar pipe 210, and one or more pipe connecting sleeves 200 to some form of load to be lifted or held. Alternatively, two or more pipe connecting sleeves 200 may be used to connect multiple spreader bar pipes of substantially the same diameter and length, or of differing lengths.

FIGS. 5A-5B and 6A-6B show details of a pipe connecting sleeve 500. Pipe connecting sleeve 500 may be used in connecting together two spreader bar pipes. For example, pipe connecting sleeve 500 may be used to connect a first spreader bar pipe 505 (shown with hash marks) to a second spreader bar pipe 510 (also shown with hash marks), having different diameters. Spreader bar pipe 505 and spreader bar pipe 510 may be of the same or differing lengths.

Pipe connecting sleeve 500 may include a top portion 511, a bottom portion 513, a first side 515, a second side 520, and a flange 525 located in a middle portion of pipe connecting sleeve 500 between first side 515 and a second side 520. First side 515 of pipe connecting sleeve 500 may include a groove 530 at flange 525 to capture a cut-end diameter of first spreader bar pipe 505. Groove 530 may be a recessed groove recessing inwardly into flange 525. First side 515 of pipe connecting sleeve 500 may further include a circular extension 535 extending from flange 525 and an end plate 540 at an end of circular extension 535 for capturing an inner diameter 545 of first spreader bar pipe 505. Second side 520 of pipe connecting sleeve 500 may include a groove 550 at flange 525 to capture a cut-end diameter 555 of second spreader bar pipe 510. Second side 520 of pipe connecting sleeve 500 may further include a circular extension 560 extending from flange 525 and an end plate 565 at the end of the circular extension 560 to capture inner diameter 555 of second spreader bar pipe 510. Circular extension 560, end plate 565, and groove 550 on second side 520 may be sized different than circular extension 535, end plate 540, and groove 530 on first side 515 for the purpose of connecting to second spreader bar pipe 510 of a different diameter than first spreader bar pipe 505. Pipe connecting sleeve 500 may connect first spreader bar pipe 505 and second spreader bar pipe 510 having a different diameter, and possibly of a different length, for example, as shown in spreader bar assembly 700 in FIG. 7.

In a preferred embodiment, end plates 540 and 565 are substantial circular in shape, and have a diameter preferably greater than that of circular extension 535 and 560, respectively. End plates 540 and 565 are preferably fixed to circular extension 535 and 560, respectively, in an offset manner (off center), such that a greater portion B of end plates 540 and 565 extend beyond the outer diameter of circular extension 535 and 560, respectively, at bottom portion 513 than portion A at top portion 511 of pipe connecting sleeve 500, such that B>A. In one example, end plates 540 and 565 extend beyond the outer diameters of circular extension 535 and 560, respectively, at bottom portion 513 of pipe connecting sleeve 500 to achieve a spacing Y, wherein Y is a vertical distance measured from a bottom most edge 540*a* and 565*a* of end plate 540 and 565, respectively to a bottom inner edge 530*a* and 550*a* of groove 530 and 550, respectively. In a preferred embodiment, Y may be equal to a wall thickness of the corresponding spreader bar pipe (e.g., first spreader bar pipe 505 or second spreader bar pipe 510 respectively), minus in the range of about 0.03 of an inch. For example, for a spreader bar pipe having a 0.5 inch wall thickness Y may be in the range of about 0.47 of an inch.

Figure 6A:
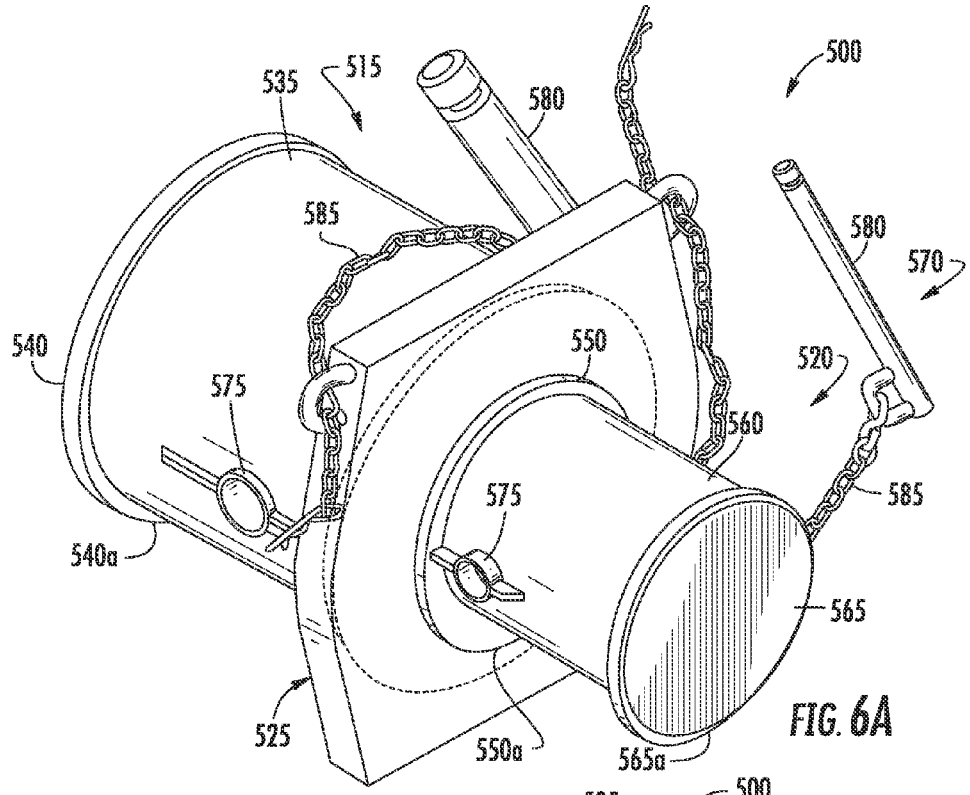
FIG. 6A shows a perspective view of another pipe connecting sleeve for connecting spreader bar pipes of different diameters together.
Figure 6B:
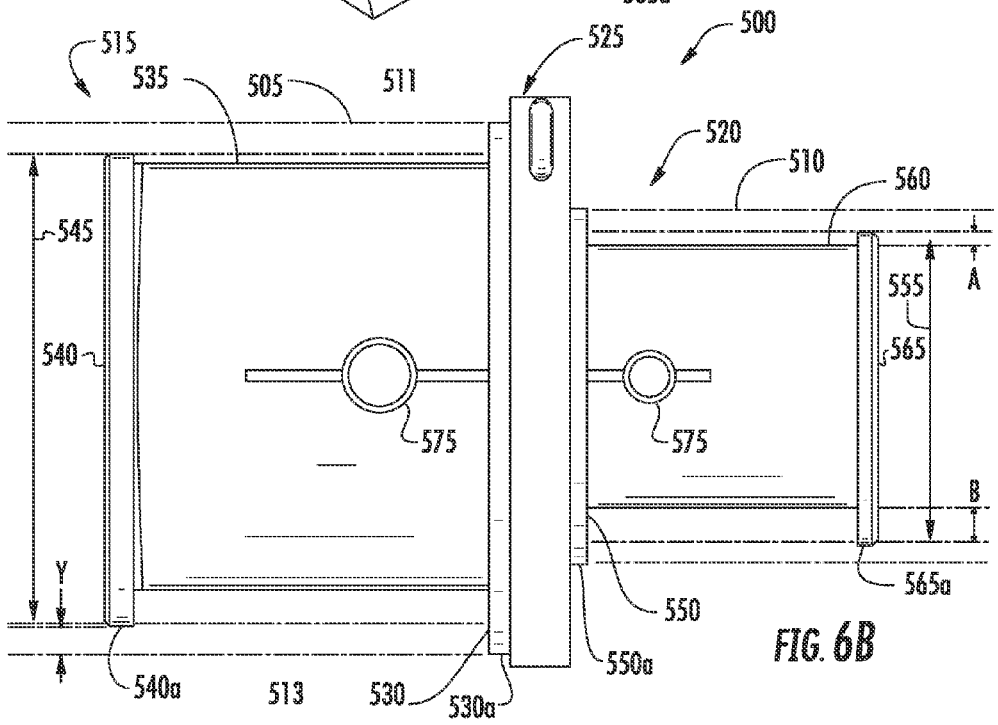
FIG. 6B shows a side view of the pipe connecting sleeve of FIG. 6A.

Grooves 530 and 550 may alternatively, extend as a shoulder from their respective sides of flange 525, instead of being recessed, to capture the cut-end diameter of the spreader bar pipe (see for example FIGS. 6A and 6B). In yet another alternative, one of grooves 530 and 550 may be a recessed groove and the other may extended as a shoulder.

First side 515 and second side 520 of pipe connecting sleeve 500 may further include one or more pin assemblies 570, or other suitable mechanism, preferably having a pin assembly 570 on each side of flange 525 for connecting pipe connecting sleeve 500 to first spreader bar pipe 505 and to second spreader bar pipe 510. Each spreader bar pipe 505 and 510 may have holes (not shown) that align with holes 575 in respective first side 515 and second side 520 of pipe connecting sleeve 500 to receive a connecting pin 580, or other suitable mechanism, of pin assembly 570. Connecting pin 580 may, itself, be attached to pipe connecting sleeve 500 via a chain 585, or other suitable mechanism.

Figure 7:
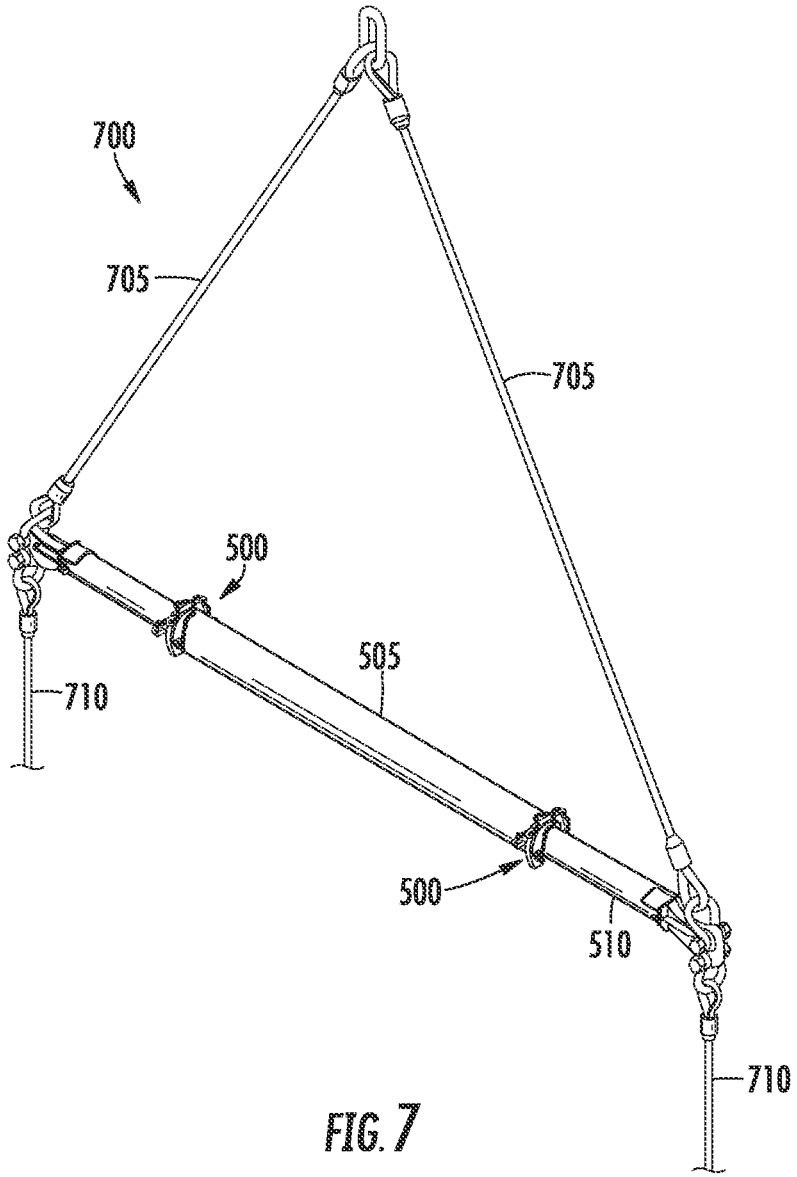
FIG. 7 shows a perspective view of a spreader bar assembly that includes pipe connecting sleeves for connecting spreader bar pipes of different diameters together.

FIG. 7 shows an example spreader bar assembly 700 that may include one or more pipe connecting sleeves 500 and two or more spreader bars, e.g., first spreader bar pipe 505 and second spreader bar pipe 510. In one example, first spreader bar pipe 505 and second spreader bar pipe 510 are of differing diameters and possibly lengths, and are joined together by pipe connecting sleeves 500. Spreader bar assembly 700 may further include cables 705, such as Y-cables, attaching first spreader bar pipe 505 and second spreader bar pipe 510, and one or more pipe connecting sleeves 500 to a lift mechanism such as a crane; and cables 510 attaching first spreader bar pipe 505 and second spreader bar pipe 510, and one or more pipe connecting sleeves 500 to some form of load to be lifted or held. Pipe connecting sleeves 500 may be used to connect multiple spreader bar pipes of different diameters and lengths, or of different diameters and substantially the same lengths.

The invention described herein, provides an improved spreader bar pipe connection sleeve that overcomes a number of shortcomings of conventional spreader bar assemblies, by substantially reducing or eliminating all of the initial sag while still maintaining load capacity, and also allowing for the use of more than one spreader bar pipe connection sleeve to be used in a single spreader bar assembly while also still maintaining load capacity.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

The foregoing detailed description of embodiments refers to the accompanying drawings, which illustrate specific embodiments of the invention. The term "the invention" or the like is used with reference to certain specific examples of the many alternative aspects or embodiments of the applicant's invention set forth in this specification, and neither its use nor its absence is intended to limit the scope of the applicant's invention or the scope of the claims. This specification is divided into sections for the convenience of the reader only. Headings should not be construed as limiting of the scope of the invention. The definitions are intended as a part of the description of the invention. It will be understood that various details of the present invention may be changed without departing from the scope of the present invention. Furthermore, the foregoing description is for the purpose of illustration only, and not for the purpose of limitation, as the present invention is defined by the claims as set forth hereinafter.

What is claimed is:

1. A pipe connecting sleeve with offset end plate for use in a spreader bar assembly for connecting a first and second spreader bar pipe, the sleeve comprising:

a) a flange having a first side and a second side;

b) a first insertion part comprising an extension portion extending from the flange first side comprising a distal end, the distal end comprising an end plate, the end plate being adapted for abutment with an inside diameter of the first spreader bar pipe, wherein the end plate is of a greater diameter than the extension portion and is fixed in an offset manner relative thereto;

c) a second insertion part comprising an extension portion extending from the flange second side comprising a distal end, the distal end comprising an end plate, the end plate being adapted for abutment with an inside diameter of the second spreader bar pipe, wherein the end plate is of a greater diameter than the extension portion and is fixed in an offset manner relative thereto;

d) a first groove formed on the first side of the flange, the first groove adapted for receiving an end of the first spreader bar pipe;

e) a second groove formed on the second side of the flange, the second groove adapted for receiving an end of the second spreader bar pipe; and wherein the end plates are fixed to their respective extension portions in an offset manner, such that a greater portion of the end plate extends below an outer diameter of the extension portion than extends above the extension portion.

2. The pipe connecting sleeve of claim 1, wherein the end plates are fixed to their respective extension portions in an offset manner, such that a greater portion of the end plate extends below an outer diameter of the extension portion than extends above the extension portion to achieve a spacing Y.

3. The pipe connecting sleeve of claim 2, wherein Y is substantially equal to a vertical distance measured from a bottom most edge of the end plate to a bottom outer edge of its respective groove.

4. The pipe connecting sleeve of claim 2, wherein Y is substantially equal to a wall thickness of one of the spreader bar pipes minus in the range of about 0.03 of an inch.

5. The pipe connecting sleeve of claim 1 further comprising a fastener mechanism for securing at least one of the insertion parts to at least one of the spreader bar pipes.

6. The pipe connecting sleeve of claim 1 wherein the end plates comprise machined steel plates.

7. The pipe connecting sleeve of claim 1 wherein at least one of the first or second grooves extends outward from one of the first side or second side of the flange.

8. The pipe connecting sleeve of claim 1 wherein at least one of the first or second grooves recesses into one of the first side or second side of the flange.

9. The pipe connecting sleeve of claim 1 wherein the first insertion part and second insertion part each have a different diameter from one another.

10. The pipe connecting sleeve of claim 9 wherein the first and second spreader bar pipes are different diameters.

11. The pipe connecting sleeve of claim 9 wherein the first and second spreader bar pipes are of substantially a same diameter.

12. The pipe connecting sleeve of claim 1 wherein the first insertion part and second insertion part each have substantially a same diameter as one another.

* * * * *